United States Patent [19]

Sebastian

[11] Patent Number: 4,942,646

[45] Date of Patent: Jul. 24, 1990

[54] SHIRT COLLAR BUTTONING DEVICE

[76] Inventor: Gabriel Sebastian, P.O. Box 891 c/o KOA, Indiana Head, Saskatchewan, Canada, S0G 2K0

[21] Appl. No.: 386,776

[22] Filed: Jul. 31, 1989

[30] Foreign Application Priority Data

Sep. 29, 1988 [CA] Canada ..... 578765

[51] Int. Cl.[5] ..... A44B 1/18; B25F 1/00

[52] U.S. Cl. ..... 24/40; 7/123; 7/169

[58] Field of Search ..... 24/40, 41, 546, 579, 24/678, 16 R, 19, 67.9; 81/9.4; 294/33, 26; 7/123, 169

[56] References Cited

U.S. PATENT DOCUMENTS

| | | | |
|---|---|---|---|
| 215,612 | 5/1879 | Howland . | |
| 240,632 | 4/1881 | Adamson | 24/40 |
| 319,015 | 6/1885 | Paine | 24/41 |
| 339,055 | 3/1886 | Henderson . | |
| 385,498 | 7/1888 | Brinton | 294/33 |
| 413,314 | 10/1889 | Betzel . | |
| 579,262 | 3/1897 | Esterly . | |
| 691,853 | 1/1902 | Freck | 24/40 |
| 893,541 | 7/1908 | Plemon | 294/33 |
| 1,197,358 | 9/1916 | Eschenbrenner | 24/40 |
| 1,291,563 | 1/1919 | Laughlin . | |
| 1,469,437 | 10/1923 | Fredrickson . | |
| 1,976,623 | 10/1934 | Monroe et al. | 294/33 |
| 2,912,733 | 11/1959 | Layman . | |
| 3,683,459 | 8/1972 | Johansen . | |
| 4,247,140 | 1/1981 | Gordon | 24/546 |

OTHER PUBLICATIONS

*Primary Examiner*—Victor N. Sakran
*Attorney, Agent, or Firm*—Jacobson & Johnson

[57] ABSTRACT

This device is formed from a one piece length of wire and includes a pair of wire members forming a short handle which then inclines downwardly and spreads apart and extends parallel to the handle and then converges and inclines upwardly at the closed ended tip portion thereof. The closed ended tip is engaged through the button hole and over the button with the widest part spreading the button hole transversely thus enable the button to be pulled through easily whereupon the hole returns to its original elongated configuration and the device can be easily disengaged from the button. The stepped portion spaces the handle clear of the shirt surface for ease of manipulation and eliminates distortion of the neck portion of the shirt as it is used to engage the button through the button hole thereby eliminating strain on the button and preventing creasing from occurring.

4 Claims, 1 Drawing Sheet

SHIRT COLLAR BUTTONING DEVICE

This invention relates to new and useful improvements in devices for assisting in the buttoning of shirt collars although it can of course be used for other buttons such as at the cuffs or down the front of the shirt.

Several buttoning devices are known to applicant but they suffer from disadvantages among which includes the difficulty in manipulating same, the distortion of the shirt collar fabric during operation and the necessity to form several sequential somewhat intricate maneuvers in order to firstly engage the button with the device and then manipulate the button through the button hole whereupon the device is disengaged.

Prior art known to applicant includes the following.

F. G. L. Henderson U.S. Pat. No. 339,055, Mar. 30, 1886,. This is primarily a boot and glove buttoner with an open button engaging end which requires considerable strain to be placed upon the button as it is levered through the button hole, which strain is not appropriate for use upon a shirt button.

U.S. Pat. No. 1,291,563, Jan 14, 1919, shoe and glove buttoner. This also has an open button engaging end and clearly shows the strain placed upon the button as it is forced through the button hole.

Johansen U.S. Pat. No. 3,683,459, Aug. 15, 1972. This is an open ended shirt button accessory consisting of two parts which have to be manipulated and relies on the spring action of the two opposed open ended wires.

U.S. Pat. No. 579,262, Mar. 23, 1897. This shows a buttoning device having a planar main portion with a handle at right angles thereto. This utilizes a hook and handle portion one of which swivels relative to the other during operation.

L. J. Layman U.S. Pat. No. 2,912,733, Nov. 17, 1959. This shows a button hook designed specifically for use by a hand amputee and includes an open ended hook to engage the button being angulated in a transverse plane.

F. Fredrickson U.S. Pat. No. 1,469,437, Oct. 2, 1923,. This shows a flat metal sheet member having an angulated button engaging end and is designed primarily for use in order to hold the button in position through the button hole as the tie is tied.

S. F. Howland U.S. Pat. 215,612, May 20, 1879. This shows a buttoning device for gloves with the handle and the buttoner being in the same plane.

The present device overcomes advantages inherent with the prior art devices inasmuch as it is made from one length of wire which may be angulated and terminate in a handle portion which may or may not be covered by a smooth surfaced element.

The buttoning portion thereof inclines downwardly and outwardly from the front end of the handle and then forwardly running parallel to the handle portion and converging towards a slightly upturned closed ended button engaging front end portion.

In accordance with the invention there is provided a shirt collar buttoning device formed from a one piece length of wire and having a front collar button engaging end and a rear handle end and comprising a planar rear handle portion of spaced apart wires diverging at the forward ends thereof and then inclining downwardly and forwardly from the transverse plane of the handle portion and diverging from one another, then extending forwardly parallel to but spaced forwardly of the handle portion in a transverse plane below the transverse plane of the handle portion and then inclining slightly upwardly and converging to terminate in a rounded closed forward end portion constituting the said front collar button engaging end, the plane of which is lower than the transverse plane of the handle portion.

The stepped portion formed along the length of the device is particularly useful not only to space the handle portion well above the surface of the shirt collar during use which prevents any potential soiling of the collar and creasing thereof but also because the wires forming this portion diverge outwardly, the button hole is spread apart transversely to the length thereof thus opening same to facilitate the engagement of the button through the button hole as it is drawn into position with the diverging forward end permitting the button hole to close under the button at the completion of the action.

A further advantage of the invention is to provide a device of the character herewithin described which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
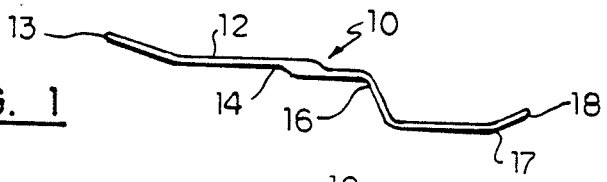
FIG. 1 is a side elevation of the device.
Figure 2:
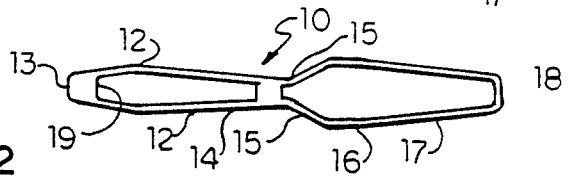
FIG. 2 is a top plan view of FIG. 1.
Figure 3:
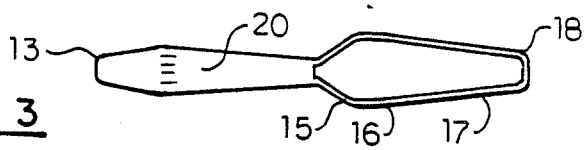
FIG. 3 is a view similar to FIG. 2 but showing the closed handle of the preferred embodiment.

Proceeding therefore to describe the invention in detail, the button holing device collectively designated 10 is preferably formed from one length of wire Which is angulated symmetrically around longitudinally extending axis 11 and includes the two ends 12 which are substantially parallel one with the other and which terminate at the rear end 13.

The front ends 14 of these two handle wire portions then diverge outwardly slightly as at 15, one from the other and then incline downwardly and forwardly as at 16 to form the step portion whereupon they extend forwardly substantially parallel to the handle portion 12 as indicated by reference character 17. The wire portions forming 17, converge towards one another and then turn upwardly slightly at the closed curved button engaging front end portion 18. It should be noted that the portion 17 is in a transverse plane below the transverse plane of the handle portion and that the front end extremity 18 is in a transverse plane above the transverse plane of the portion 17 but below the transverse plane of the handle portion 12.

Once formed, the rear ends 13 may be joined as by solder 19 if desired or, preferably, enclosed in a smooth casing portion 20 formed from metal or plastic to assist in the handling of the device In operation, the front end portion 18 is engaged through the button hole 21 of one end 22 of a shirt collar 23.

Figure 4:
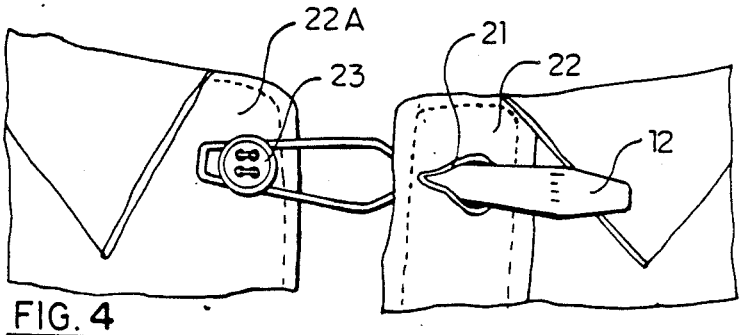
FIG. 4 shows a fragmentary front elevation of an open shirt collar with the device engaged through the button hole and over the button.
Figure 5:
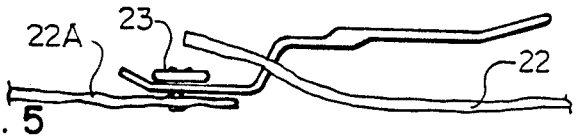
FIG. 5 is a partial schematic view at right angles to FIG. 4.

It is then pushed through the button hole maintaining it in the same plane as the tab portion 22 so that the beginning of the portion 17 spreads or distorts the button hole transversely as clearly shown in FIG. 4. The end 18 is then engaged over the button 23 and drawn rearwardly and it will be noted that the width of the wires forming this end are less than the diameter of the button so that the button is locked in position.

Figure 6:
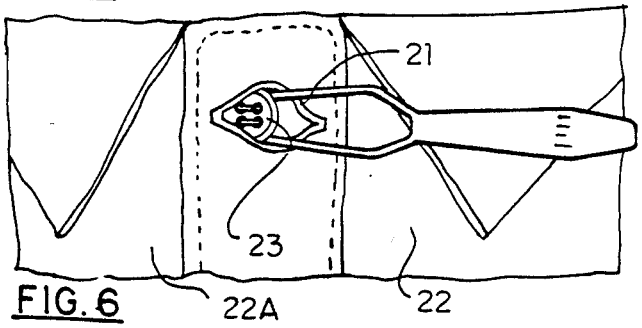
FIG. 6 is a view similar to FIG. 4 but showing the button about to be engaged through the button hole.

The device is then pulled so that the button which is attached to the other tab portion 22A is drawn towards the button hole 21 as clearly shown in FIG. 6 which remains distorted so that the button is easily pulled therethrough whereupon the converging sides of the portion !7 allow the button hole to close to the elongated slot position thus retaining the button whereupon the device is moved to the left with reference to the drawings thus disengaging the device from around the button so that it can be removed. The action is relatively easy and can be carried out with little if any distortion or creasing of the shirt collar with the exception of distending the button hole during the operation of the device.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A shirt collar buttoning device formed from a one piece length of wire and having a front collar button engaging end and a rear handle end and comprising a planar rear handle portion of spaced apart wires diverging at the forward ends thereof and then inclining downwardly and forwardly from the transverse plane of the handle portion and diverging from one another, then extending forwardly parallel to but spaced forwardly of the handle portion in a transverse plane below the transverse plane of the handle portion and then inclining slightly upwardly and converging to terminate in a rounded closed forward end portion constituting the said front collar button engaging end, the plane of which is lower than the transverse plane of the handle portion.

2. The device according to Claim 1 in which the rear end of the handle portion inclines upwardly slightly from the transverse plane of the remaining handle portion.

3. The device according to Claim 1 in which the handle portion is enclosed within a smooth finger engaging member.

4. The device according to Claim 2 in which the handle portion is enclosed within a smooth finger engaging member.

* * * * *

UNITED STATES PATENT AND TRADEMARK OFFICE

CERTIFICATE OF CORRECTION

PATENT NO. : 4,942,646

DATED : July 24, 1990

INVENTOR(S) : GABRIEL SEBASTIAN

It is certified that error appears in the above-identified patent and that said Letters Patent is hereby corrected as shown below:

On the title page, item [76]:
In the inventor's address, change "Indiana" to --Indian--.

Signed and Sealed this

Sixteenth Day of June, 1992

*Attest:*

DOUGLAS B. COMER

*Attesting Officer*

*Acting Commissioner of Patents and Trademarks*